US005413827A

United States Patent [19]

Brodie, III et al.

[11] Patent Number: 5,413,827

[45] **Date of Patent: * May 9, 1995**

[54] ALDEHYDE SCAVENGING COMPOSITIONS AND METHODS RELATING THERETO

[75] Inventors: Vincent Brodie, III, Wilmington, Del.; Donna L. Visioli, Lower Gwynedd, Pa.

[73] Assignee: E. I. Du Pont de Nemours and Company, Wilmington, Del.

[ * ] Notice: The portion of the term of this patent subsequent to Feb. 8, 2011 has been disclaimed.

[21] Appl. No.: 176,740

[22] Filed: Jan. 3, 1994

[51] Int. Cl.[6] ..... B29D 22/00

[52] U.S. Cl. ..... 428/35.7; 428/213; 428/500; 428/516; 524/251

[58] Field of Search ..... 428/500, 516, 35.7, 428/213; 524/251

[56] References Cited

U.S. PATENT DOCUMENTS

| | | | |
|---|---|---|---|
| 3,033,707 | 4/1959 | Lacy et al. | 117/76 |
| 3,140,196 | 4/1959 | Lacy et al. | 117/75 |
| 3,230,135 | 7/1965 | Hurst | 161/250 |
| 4,146,590 | 3/1979 | Yamamoto et al. | 260/878 |
| 4,547,350 | 10/1985 | Gesser | 423/210 |
| 4,818,598 | 4/1984 | Wong | 428/284 |
| 4,892,719 | 1/1990 | Gesser | 423/245.1 |
| 5,284,892 | 2/1994 | Brodie, III et al. | 525/197 |

FOREIGN PATENT DOCUMENTS 374861 6/1990 European Pat. Off. .

OTHER PUBLICATIONS

"Odor Reduction in HIC Recycle", Poly and Plastic Products, Inc.

Gesser, H. D., "Removal of Aldehydes and Acidic Pollutants from Indoor Air" ES&T Research.

Gesser, H. D., "The Reduction of Indoor Formaldehyde Gas and that Emanating from Urea Formaldehyde Foam Insulation (UFFI)" Environment International, vol. 10, pp. 305–308 1984.

"Mica A-131.x Water Borne Extrusion Primer and Laminating Adhesive" Product Information.

Miltz, J. et al "The Effect of Polyethylene Contact Surface on the Shelf Life of Food Products" pp. 245–257.

Potts, M. W., et al. "Relative Taste Performace of Plastics in Food Packaging", *Journal of Plastic & Sheeting*, vol. 6, Jan. 1990, pp. 31–43.

Landois-Garza, J., et al, "Plastic Packaging Can Cause Aroma Sorption", Food Engineering Apr. 1987, pp. 39–42.

Tavss, E. A., et al. "Analysis of Flavor Absorption into Plastic Packaging Materials Using Multiple Head Space Extraction Gas Chromatography", *Journal of Cheomatography* 438, (1988) 281–289.

Salame, M., "Reataining Flavor in Plastics-Packaged Products", *Plastics Packaging*, 1988.

Aminobhavi T. M., et al, "An Overview of the Theoretical Models Used to Predict Transport of Small Molecules Through Polymer Membranes", *JMS Rev. Macromol Chem Phys* C28(3&4) 421. 474 (1988).

Kail, J. A. E., "Flavor Barrier Evaluation Enhances Material Selection" *Packaging* Sep. 1984 pp. 68–70.

*Primary Examiner*—Edith Buffalow

*Attorney, Agent, or Firm*—Konrad S. Kaeding

[57] ABSTRACT

The present invention relates generally to packaging materials which enhance food freshness, particularly for foods having a high fat content. The packaging materials of the present invention comprise an aldehyde scavenger, such as, polyethylene imine, and optionally, an oxygen scavenger.

7 Claims, No Drawings

ALDEHYDE SCAVENGING COMPOSITIONS AND METHODS RELATING THERETO

FIELD OF THE INVENTION

The present invention relates generally to packaging materials which enhance food freshness, particularly for foods having a high fat content. More specifically, the packaging materials of the present invention comprise an aldehyde scavenger, such as, polyethylene imine.

BACKGROUND OF THE INVENTION

Many oily foods, such as snack foods, are subject to limited shelf life, due to rancidity involving oil degradation or oxidation. "Shelf life" is intended to mean the period of time before a product's qualities become discernibly different from when it was freshly made. Over time, moisture changes and oil degradation can adversely affect the aroma, texture and taste of a packaged food. A need therefore exists in the art for a packaging product which inhibits such degradation and increases shelf life.

SUMMARY OF THE INVENTION

The present invention is directed to novel compositions comprising polyalkylene imine ("PAI"), most preferably polyethylene imine ("PEI") which are incorporated into a packaging structure, cap liner, sticker, coupon, packaging insert or the like. When incorporated into a packaging structure, the PAI concentration is preferably (on average) in the range of about 0.5 to about 80 micrograms per square centimeter, more preferably about 0.5 to about 15 micrograms per square centimeter and most preferably about 0.5 to about 8.1 micrograms per square centimeter. When incorporated into a cap liner, sticker, coupon or similar-type packaging insert, the PAI concentration is preferably (on average) in the range of about 0.5 to about 80 micrograms per square centimeter, more preferably 2 to about 40 micrograms per square centimeter, yet more preferably about 3 to about 30 micrograms per square centimeter and most preferably about 3 to about 20 micrograms per square centimeter.

The PAI aldehyde scavenger can be supported by (or incorporated into, assuming it is sufficiently aldehyde permeable) a plastic or non-plastic material. Suitable non-plastic materials include paper, paperboard, cellophane, glass, metal, elastomer and/or the like. Suitable plastic materials include polyolefins, polyesters, polyamides, polyimides and derivatives thereof. The material can be fibrous, nonfibrous, woven, non woven, oriented, unoriented, continuous and/or derivations thereof. Suitable materials include overwraps, trays, cap liners, stickers, pouches, pads, dividers and/or the like. The PAI aldehyde scavenger can be incorporated into or onto the packaging structure or can be first placed in a concentrate and incorporated as part of a masterbatch process.

DETAILED DESCRIPTION OF THE PREFERRED EMBODIMENT AND BEST MODE

Overview

The most preferred embodiment of the present invention is a sticker, cap liner, insert or similar-type device having an outer material which encompasses an "aldehyde scavenging" inner material. Each of these components will be discussed separately, and thereafter, combinations and methods of the present invention will be discussed.

Outer Material

The sticker, cap liner, insert or similar-type device of the present invention preferably comprises an outer material which substantially encloses the aldehyde-scavenging component(s) of the overall device or at least to some extent separates the aldehyde-scavenging component(s) from the contents of the package. The outer material should be wholly or partially aldehyde permeable. Preferably, the aldehyde permeability is sufficient to allow aldehyde migration into the device at a desired rate, thereby substantially maintaining an aldehyde concentration outside the device at a low level, relative to the aldehyde concentration level which would otherwise occur without the device of the present invention.

In the preferred embodiment, the outer material is suitable for food contact. That is, the outer material can be in contact with food under typical circumstances without causing any deleterious impact upon the food. Also, the outer material should be strong and durable, so a typical customer cannot easily tear open the device, thereby exposing the components within the wrap. The outer material should be non-corrosive in the sense that it is inert during its intended life cycle.

The outer material may be of any suitable shape or construction. In this respect, it may be a coated paper or laminate, or it may be a woven polymer, or a natural fiber material or it may be a microporous material molded into form or extruded or blown into a sheet. The outer material should have sufficient aldehyde permeability for efficient aldehyde scavenging.

A preferred outer material comprises high density polyethylene ("HDPE") or similar-type fibers combined by an integrated spinning and bonding process. Spunbound HDPE provides a number of highly desirable advantages. First of all, this material will transmit water vapor and gases from the environment in which package is placed but will not pass water in a liquid form. Consequently, the device will not have its efficacy impaired in the event it is exposed to liquid water.

Also the spunbound HDPE material is many times stronger than paper and resists puncturing or tearing. Therefore the possibility of spilling the aldehyde adsorbent as the result of tearing is a very remote possibility, and practically impossible. A spunbonded olefin which has been found satisfactory can be obtained commercially under the trademark TYVEK, Style 1058, of the E. I. du Pont de Nemours Company ("DuPont"), and it is fabricated from high density polyethylene by an integrated spinning and bonding process. It has a weight of approximately 0.23 ounces per square foot, and a thickness of approximately 5 mils. It will be appreciated, however, that other weights of material can be used to obtain different aldehyde transmission characteristics.

The outer material may be tubular or fabricated from planar sheet material, having a heat-sealed seam and heat sealed ends. Heat sealing compositions are well known and particularly preferred such adhesive compositions include low or ultralow density polyethylenes and more preferably ethylene copolymer, particularly ethylene/methacrylic acid or ethylene/acrylic acid copolymer, most particularly wholly or partially neutralized with a cation, such as, zinc or sodium (such neutralized acid copolymers will hereafter be referred to as "ionomers"). The outer material may be coextruded with, laminated to or coated with the aldehyde scavenger.

Other preferred outer materials include: 1. porous plastic, paper or the like, such as teabag paper; and 2. aldehyde permeable polymeric materials, such as, copolymers of ethylene and vinyl ester, such as polyethylene vinyl acetate ("EVA") or polyester polymers or copolymers; wax (including mineral, vegetable, animal and synthetic waxes; and olefin homopolymer and copolymers, such as, ionomers, acid copolymers, polyolefin copolymers and the like. Preferably, where the outer material is substantially continuous, the material is in the range of about 20% to about 40% amorphous and the preferred thickness (on average) is in the range of about 0.001 mils to about 100 mils, more preferably 0.01 to about 30 mils and most preferably about 0.03 to about 10 mils.

Aldehyde Scavenging Component.

The preferred aldehyde scavenging component is a polyalkylene imine ("PAI"). The preferred PAI of the present invention can be defined according to the following structure:

$$H-(-CH_2-(CH_2)_n-NH-)_m-H$$

in which n and m are the same or different and have a numerical value of at least 1. A high percentage of nitrogen is preferred, and therefore preferably, n is 1 to 4, more preferably 1 (polyethylene imine or "PEI"), and m is preferably a value of a hundred or more. It is generally most advantageous to avoid use of very low molecular weight materials having excessive amounts of materials which can migrate. The most preferred molecular weigh (determined by light scattering) is preferably above about 800 and more preferably above about 1500 and most preferably above about 2500.

PEI can be synthesized from aziridine (or ethyleneimine) generally through sulfonic acid esterification of ethanolamine; the monomer is then reacted in an acid-catalyzed ring-opening homopolymerization to form the PEI molecule. In the most preferred embodiment, the PEI is not heavily branched and preferably has a relatively low percentage of tertiary amines.

Optional Additives

In addition to an aldehyde scavenging material, a moisture or oxygen scavenging material can be incorporated into the devices of the present invention. Moisture scavenging desiccants are well known and include molecular sieves, silica gels, calcium oxide and the like.

Oxygen scavengers useful in accordance with the present invention include those compounds that cause elemental oxygen to react to form a substantially unreactive compound. "Elemental oxygen" is intended to mean oxygen in the $O_2$ state, either as a free gas or dissolved in another substance. A "substantially unreactive compound" is intended to mean that the elemental oxygen is either bound, so it cannot participate in a chemical reaction, or it reacts to form a compound that has a lower oxidation potential than elemental oxygen. Thus, the ability of the oxygen to oxidize the food is reduced. Such compounds include oxygen scavengers such as iron and iron oxide, antioxidants such as BHA and BHT, or enzymes such as glucose oxidize that catalyze the reaction of oxygen with the enzyme substrate.

Other optional additives include aroma-generating compounds, such as for instance in the packaging of foods based on citrus fruits, the aroma generating compound could be: limonene, lemon oil or the like.

"Binding Agents" can be added to the compositions of the present invention to further "lock in" other components. Useful binding agents include functionalized polymers, such as, functionalized olefinic polymers and copolymers, particularly polymers functionalized with carboxyl functionality, most particularly anhydride functionality.

Other optional additives include plasticizers, tackifiers, processing aids, pigments and the like, including any conventionally known additive for the production of films for packaging applications.

Final Product

The devices of the present invention comprising an aldehyde scavenging inner material and an aldehyde permeable outer material can be incorporated into a cap liner, coupon, sticker, packaging divider or similar-type insert. The devices of the present invention can be large, such as a large sealed pouch (having an adhesive or non-adhesive backing) containing an aldehyde scavenger, or can be quite small, such as, tiny beads which can be adhered to another substrate, such as a cap liner, sticker or coupon.

Alternative Embodiments

An alternative to a sticker, cap liner, insert or similar-type device, is to incorporate the aldehyde scavenger directly into the packaging structure, either by incorporating the aldehyde scavenger directly or with a masterbatch, during the production of the film structure; the aldehyde scavenger can be incorporated into one or more layers of a film or can be coated onto one or more film layers. It has been surprisingly found that although the high viscosity of PEI would indicate difficulty in pumping and metering into a melt stream, a back pressure of only about 20 psig was able to transport an adequate amount of PEI to be incorporated into a melt stream in accordance with the present invention.

In a preferred embodiment, a functional barrier is placed over a PAI containing layer. The functional barrier is preferably permeable to aldehydes but substantially impermeable to PAIs. Functional barriers of three mils or greater are possible, although thicknesses of less than one mil are preferred. Suitable functional barrier layer materials include any aldehyde permeable material described above.

What is claimed is:

1. A packaging material having an inner surface which encloses a product and an outer surface, the packaging material comprising:

polyalkylene imine ("PAI") in an amount less than about 16 micrograms per square centimeter and greater than about 1.8 micrograms per square centimeter, wherein the PAI is either exposed at the inner surface of the packaging material or is separated from the inner surface of the packaging material by an aldehyde permeable material, provided that if the aldehyde permeable material comprises a hydrocarbon polyolefin layer, the hydrocarbon polyolefin layer is less than 0.25 mils thick.

2. A packaging material according to claim 1 whereby the aldehyde permeable material does not comprise a hydrocarbon polyolefin layer.

3. A packaging material according to claim 1 wherein the PAI is polyethylene imine ("PEI").

4. A packaging material according to claim 1 whereby the concentration of polyalkylene imine ("PAI") is less than about 8.1 micrograms per square centimeter.

5. A packaging material according to claim 1 further comprising a moisture or oxygen scavenger.

6. A cap liner, sticker, coupon, tray or other packaging insert, the improvement comprising:

a PAI aldehyde scavenger having a concentration greater than 3 micrograms per square centimeter and having a molecular weight of greater than about 1000.

7. A composition according to claim 6 further comprising an oxygen or moisture scavenger.

* * * * *